US009728127B2

(12) United States Patent
In et al.

(10) Patent No.: US 9,728,127 B2
(45) Date of Patent: Aug. 8, 2017

(54) PIXEL AND ORGANIC LIGHT EMITTING DISPLAY INCLUDING THE SAME

(71) Applicant: SAMSUNG DISPLAY CO., LTD., Yongin, Gyeonggi-Do (KR)

(72) Inventors: Hai-Jung In, Yongin (KR); Yong-Sung Park, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 26 days.

(21) Appl. No.: 14/489,968

(22) Filed: Sep. 18, 2014

(65) Prior Publication Data

US 2015/0103070 A1 Apr. 16, 2015

(30) Foreign Application Priority Data

Oct. 14, 2013 (KR) ..... 10-2013-0121682

(51) Int. Cl.
*G09G 3/3233* (2016.01)

(52) U.S. Cl.
CPC ... *G09G 3/3233* (2013.01); *G09G 2300/0443* (2013.01); *G09G 2300/0814* (2013.01); *G09G 2300/0842* (2013.01); *G09G 2330/08* (2013.01)

(58) Field of Classification Search
None
See application file for complete search history.

(56) References Cited

U.S. PATENT DOCUMENTS

| | | | | |
|---|---|---|---|---|
| 2002/0140641 | A1 | 10/2002 | Mikami et al. | |
| 2006/0132395 | A1 * | 6/2006 | Kawasaki | G09G 3/325 345/75.2 |
| 2008/0062096 | A1 | 3/2008 | Yamashita et al. | |
| 2009/0315874 | A1 | 12/2009 | Kim | |
| 2010/0026729 | A1 | 2/2010 | Toyomura et al. | |
| 2010/0053040 | A1 * | 3/2010 | Nishi | G09G 3/20 345/76 |
| 2012/0113077 | A1 * | 5/2012 | Kang | G09G 3/003 345/211 |
| 2013/0342589 | A1 * | 12/2013 | Jung | G09G 3/32 345/690 |
| 2016/0125803 | A1 * | 5/2016 | Qing | G09G 3/3233 345/209 |

FOREIGN PATENT DOCUMENTS

| | | |
|---|---|---|
| JP | 2008-65200 | 3/2008 |
| JP | 2012-008404 | 1/2012 |
| KR | 2002-0077007 | 10/2002 |
| KR | 10-2009-0020466 | 2/2009 |
| KR | 10-2009-0131405 | 12/2009 |
| KR | 10-2010-0012826 | 2/2010 |

* cited by examiner

*Primary Examiner* — Nicholas Lee
*Assistant Examiner* — Duane N Taylor, Jr.
(74) *Attorney, Agent, or Firm* — Lee & Morse P.C.

(57) ABSTRACT

A pixel includes a driving circuit, a first organic light emitting diode, a second organic light emitting diode, and a self-repair circuit. The driving circuit supplies current based on a data signal supplied through a data line. The first organic light emitting diode is coupled to the driving circuit through a first current path. The second OLED is coupled to the driving circuit through a second current path. The self-repair circuit interrupts the first current path and supplies the current to the second current path when the first organic light emitting diode has a defect.

20 Claims, 7 Drawing Sheets

PIXEL AND ORGANIC LIGHT EMITTING DISPLAY INCLUDING THE SAME

CROSS-REFERENCE TO RELATED APPLICATION

Korean Patent Application No. 10-2013-0121682, filed on Oct. 14, 2013, and entitled, "PIXEL AND ORGANIC LIGHT EMITTING DISPLAY INCLUDING THE SAME," is incorporated by reference herein in its entirety.

BACKGROUND

1. Field

One or more embodiments described herein relate to a display device.

2. Description of the Related Art

A variety of flat panel displays have been developed. Examples include liquid crystal displays, field emission displays, plasma display panels, and organic light emitting displays. An organic light emitting display uses organic light emitting diodes (OLEDs) to emit light based on a recombination of electrons and holes in an active layer. Displays of this type have fast response speeds and output clear images.

Different methods may be used to display gray scale values in an organic light emitting display. These methods include an analog driving method and a digital driving method.

An analog driving method displays gray scale values by changing the amplitude of current applied to the OLED based on a data signal. The changed amplitude of the current adjusts emission luminance of the OLED. Thus, in an analog driving method, the amplitude of a data signal applied to each pixel is controlled for the same emission time of the OLED, and the amplitude of a voltage or current supplied to the OLED is adjusted to thereby express light of a specific gray scale value.

A digital driving method displays gray scale values by controlling the emission time of the OLED in each pixel based on a data signal. In one type of digital driving method, current of a predetermined amplitude is applied to the OLED based on the amplitude of a voltage. The turn-on time of the OLED is controlled through an applied data signal when emission luminance of the OLED is constantly maintained. As a result, light is emitted at a specific gray scale value.

SUMMARY

In accordance with one embodiment, a pixel includes a driving circuit configured to supply current based on a data signal supplied through a data line; a first organic light emitting diode (OLED) coupled to the driving circuit through a first current path; a second OLED coupled to the driving circuit through a second current path; and a self-repair circuit configured to interrupt the first current path and supply the current to the second current path when the first OLED is short-circuited.

The self-repair circuit may equally supply the current to the first current path and the second current path when the first OLED is not short-circuited The self-repair circuit may increase an amount of a second current flowing through the second current path when the first OLED is short-circuited, and the increased amount of the second current may be based on a reduction in an amount of a first current flowing through the first current path.

The self-repair circuit may include a first transistor configured to have a first electrode coupled to the driving circuit, a second electrode coupled to a first node, and a gate electrode coupled to an anode electrode of the second OLED: a second transistor configured to have a first electrode coupled to the driving circuit, a second electrode coupled to a second node, and a gate electrode coupled to an anode electrode of the first OLED; a third transistor configured to have a first electrode coupled to the first node, and a second electrode and a gate electrode, coupled to the anode electrode of the first OLED; and a fourth transistor configured to have a first electrode coupled to the second node, and a second electrode and a gate electrode, coupled to the anode electrode of the second OLED. The first and second transistors may operate in a saturation region.

The first to fourth transistors may be same-channel field effect transistors. The self-repair circuit may include a first transistor configured to have a first electrode coupled to a first node, a second electrode coupled to an anode electrode of the first OLED, and a gate electrode coupled to an anode electrode of the second OLED; a second transistor configured to have a first electrode coupled to a second node, a second electrode coupled to the anode electrode of the second OLED, and a gate electrode coupled to the anode electrode of the first OLED; a third transistor configured to have a first electrode coupled to the driving circuit, and a second electrode and a gate electrode, coupled to the first node; and a fourth transistor configured to have a first electrode coupled to the driving circuit, and a second electrode and a gate electrode, coupled to the second node.

In accordance with another embodiment, an organic light emitting display includes a data driver configured to supply data signals to data lines; a scan driver configured to progressively supply a scan signal to scan lines; and a display unit configured to include pixels respectively arranged at intersection portions of the data lines and scan lines, wherein each pixel includes: a first organic light emitting diode (OLED); a second OLED; a driving circuit configured to control an amount of current flowing from a first power source to a second power source through the first and second OLEDs based on a data signal supplied through a corresponding one of the data lines, when the scan signal is supplied to a corresponding one of the scan lines; and a self-repair circuit configured to interrupt a first current supplied to the first OLED when the first OLED is short-circuited.

The self-repair circuit may equally supply the current supplied from the driving circuit to the first and second OLEDs when the first OLED is not short-circuited. The self-repair circuit may increase an amount of a second current supplied to the second OLED when the first OLED is short-circuited, and the increased amount of the second current may be based on a reduction in the first current.

The self-repair circuit may include a first transistor configured to have a first electrode coupled to the driving circuit, a second electrode coupled to a first node, and a gate electrode coupled to an anode electrode of the second OLED, a second transistor configured to have a first electrode coupled to the driving circuit, a second electrode coupled to a second node, and a gate electrode coupled to an anode electrode of the first OLED, a third transistor configured to have a first electrode coupled to the first node, and a second electrode and a gate electrode, coupled to the anode electrode of the first OLED; and a fourth transistor configured to have a first electrode coupled to the second node, and a second electrode and a gate electrode, coupled to the anode electrode of the second OLED. The first and second transistors may operate in a saturation region. The first to fourth transistors may be same-channel field effect transistors.

The self-repair circuit may include a first transistor configured to have a first electrode coupled to a first node, a second electrode coupled to an anode electrode of the first OLED, and a gate electrode coupled to an anode electrode of the second OLED; a second transistor configured to have a first electrode coupled to a second node, a second electrode coupled to the anode electrode of the second OLED, and a gate electrode coupled to the anode electrode of the first OLED; a third transistor configured to have a first electrode coupled to the driving circuit, and a second electrode and a gate electrode, coupled to the first node; and a fourth transistor configured to have a first electrode coupled to the driving circuit, and a second electrode and a gate electrode, coupled to the second node.

The driving circuit may include a storage capacitor; a scanning transistor configured to charge, in the storage capacitor, a voltage corresponding to the data signal supplied through a corresponding one of the data lines, when the scan signal is supplied to a corresponding one of the scan lines; and a driving transistor configured to control the amount of the current based on the voltage charged in the storage capacitor.

In accordance with another embodiment, a pixel includes a first light emitter; a second light emitter; a driver circuit to supply a first current; and a control circuit to supply second current to the first light emitter and third current to the second light emitter, wherein first and second light emitters are connected in parallel, wherein the second and third currents are based on the first current, and wherein the control circuit is to supply at least a portion of the second current to the second light emitter with the third current when the first light emitter is defective.

The control circuit may supply the second current to the second light emitter with the third current when the first light emitter is defective. The first and second light emitters may be organic light emitting diodes. The third current may substantially equal the second current. The control circuit may interrupt a signal path coupled to the first light emitter to supply at least a portion of the second current to the second light emitter with the third current.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
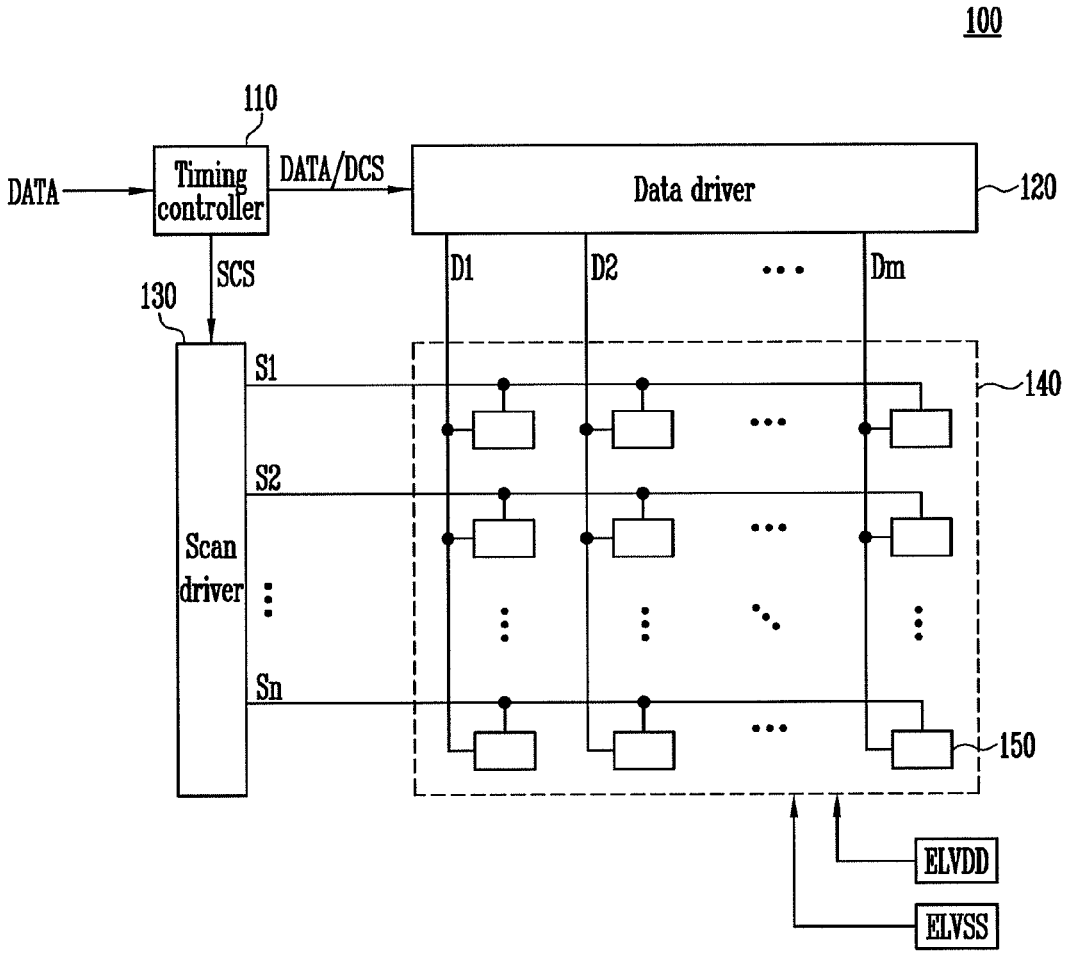
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of an organic light emitting display 100 which includes a timing controller 110, data driver 120, scan driver 130 and display unit 140.

The timing controller 110 controls operations of the data driver 120 and scan driver 130, in response to a synchronization signal externally supplied. For example, timing controller 110 generates a data driving control signal DCS and supplies the data driving control signal DCS to data driver 120. The timing controller 110 generates a scan driving control signal SCS and supplies the scan driving control signal SCS to scan driver 130.

The timing controller 110 synchronizes data DATA supplied from an external source with the data driving control signal DCS and scan driving control signal SCS, and supplies the synchronized data DATA to data driver 120.

The data driver 120 realigns data DATA supplied from timing controller 110 in response to the data driving control signal DCS from timing controller 110, and supplies the realigned data DATA as data signals to data lines D1 to Dm.

The scan driver 130 progressively supplies a scan signal to scan lines S1 to Sn, in response to scan driving control signal SCS from timing controller 110.

The display unit 140 includes pixels 150 respectively disposed at intersection portions of data lines D1 to Dm and scan lines S1 to Sn. The data lines D1 to Dm are vertically arranged and scan lines S1 to Sn are horizontally arranged.

Each pixel 150 is coupled to a corresponding one of data lines D1 to Dm and a corresponding one of scan lines S1 to Sn. Pixel 150 is controlled by a data signal supplied through the corresponding data line and a scan signal supplied through the corresponding scan line.

Each pixel 150 emits light with a luminance corresponding to the data signal supplied through the corresponding data line. For example, in a case where the organic light emitting display is driven by an analog driving method, pixel 150 expresses a gray scale value by adjusting the amplitude of current supplied to its OLED based on the data signal. If the organic light emitting display is driven by a digital driving method, pixel 150 expresses a gray scale value by controlling the turn-on time of the OLED based on the data signal.

Figure 2:
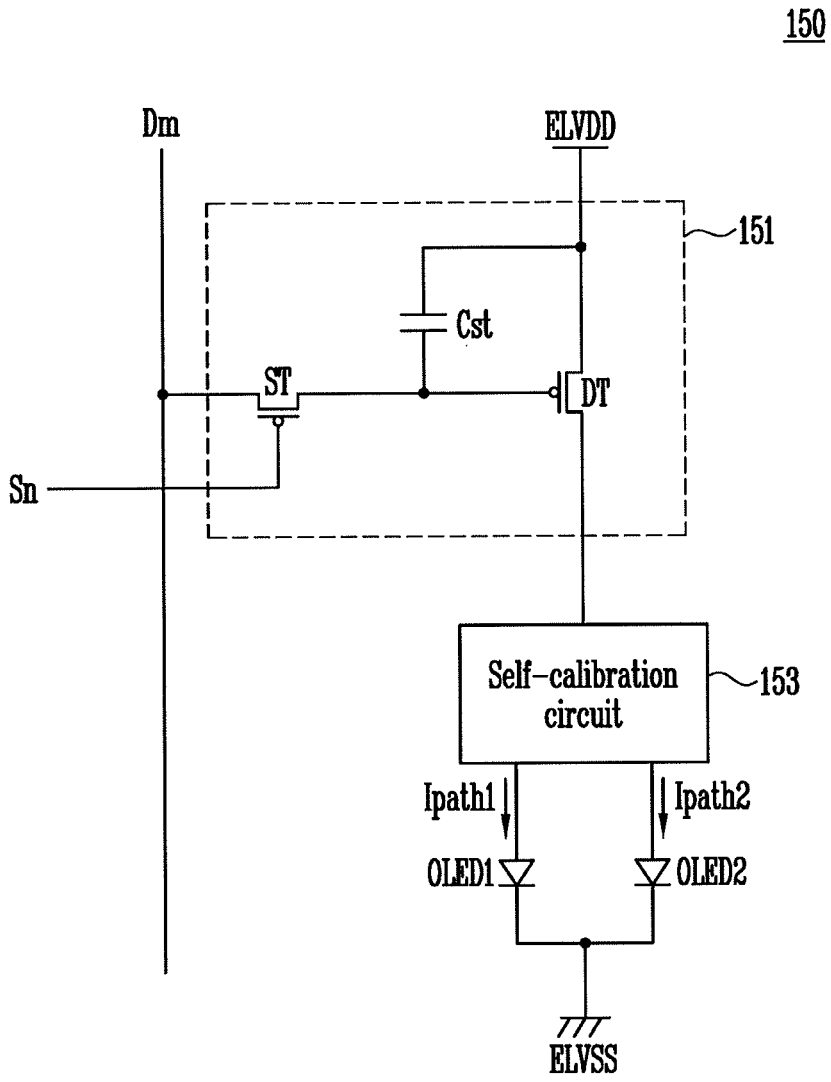
FIG. 2 illustrates an embodiment of a pixel.

FIG. 2 illustrates an embodiment of a pixel, which, for example, may correspond to pixel 150 in FIG. 1. Referring to FIG. 2, pixel 150 includes a driving circuit 151, self-repair circuit 153 and light emitters, which, for example, may be organic light emitting diodes OLED1 and OLED2. In other embodiments, a different type of light emitter may be used.

The driving circuit 151 supplies current corresponding to a data signal supplied through a data line Dm when a scan signal is supplied through a scan line Sn. For example, the driving circuit 151 charges, in storage capacitor Cst, a voltage corresponding to the data signal when the scan signal is supplied. Subsequently, driving circuit 151 supplies, to OLED1 and OLED2, current corresponding to the voltage charged in storage capacitor Cst.

The driving circuit 151 may include the storage capacitor Cst, a scanning transistor ST, and a driving transistor DT. A first terminal of storage capacitor Cst is coupled to a first power source ELVDD and a first electrode of driving transistor DT. A second terminal of storage capacitor Cst is coupled to a second electrode of scanning transistor ST and a gate electrode of driving transistor DT. When scanning transistor ST is turned on, storage capacitor Cst charges a voltage corresponding to the data signal supplied through data line Dm. The first and second electrodes may be source and drain electrodes.

A first electrode of scanning transistor ST is coupled to data line Dm. The second electrode of scanning transistor ST is coupled to the second terminal of storage capacitor Cst and the gate electrode of driving transistor DT. A gate electrode of scanning transistor ST is coupled to scan line Sn. The scanning transistor ST is turned on when the scan signal is supplied through scan line Sn, to supply the data signal from data line Dm to storage capacitor Cst.

The first electrode of driving transistor DT is coupled to first power source ELVDD and the first terminal of storage capacitor Cst. The second electrode of driving transistor DT is coupled to self-repair circuit 153. The gate electrode of driving transistor DT is coupled to the second electrode of scanning transistor ST and the second terminal of storage capacitor Cst. The driving transistor DT supplies current to OLED1 and OLED2 through self-repair circuit 153. The current supplied to OLED1 and OLED2 may have an amplitude based on the voltage in storage capacitor Cst.

When OLED1 and OLED2 operate normally (e.g., when OLED1 and OLED2 are not short-circuited or otherwise operate in a defective manner), self-repair circuit 153 equally supplies current from driving circuit 151 to OLED 1 and OLED2. For example, self-repair circuit 153 maintains the amplitude of a first current supplied to OLED1 through a first current path Ipath1 to be substantially equal to that of a second current supplied to OLED2 through a second current path Ipath2.

If either of OLED1 and OLED2 is short-circuited, self-repair circuit 153 interrupts the current supplied to the short-circuited organic light emitting diode, and supplies current to only the other organic light emitting diode. The self-repair circuit 153 may interrupt the current supplied to the short-circuited organic light emitting diode by current the current path or signal line coupled to the short-circuits OLED. Alternatively, the self-repair circuit 153 may interrupt the current by opening a switch, burning a fuse, or by another method.

In one embodiment, self-repair circuit 153 supplies, to the organic light emitting diode which is not short-circuited, the current supplied to the short-circuited organic light emitting diode. For example, if OLED1 is short-circuited, self-repair circuit 153 increases the amount of the second current supplied through second current path Ipath2, corresponding to reduction of the first current supplied through the first current path Ipath1. Thus, for example, all of the current output from driving circuit 151 may pass through the organic light emitting diode that is not short circuited.

OLED1 and OLED2 are coupled between self-repair circuit 153 and a second power source ELVSS. OLED1 and OLED2 emit light with a luminance based on current flowing from the first power source ELVDD to the second power source ELVSS through the driving circuit 151 and the self-repair circuit 153.

OLED1 is coupled to the driving circuit 151 through the first current path Ipath1. OLED1 emits light with a luminance corresponding to the first current supplied through first current path Ipath1.

OLED2 is coupled to the driving circuit 151 through second current path Ipath2. OLED2 emits light with a luminance corresponding to the second current supplied through second current path Ipath2.

Although either of OLED1 or OLED2 may be short-circuited due to a defect, in one embodiment, self-repair circuit 153 supplies the current supplied from the driving circuit 151 to the organic light emitting diode which is not short-circuited, so that the pixel 150 can express an exact gray scale value corresponding to the data signal. In alternative embodiment, a predetermined portion of current from the first current path Ipath1 may be combined with the current in Ipath2 and supplied to the organic light emitting diode that is not short circuited.

Figure 3:
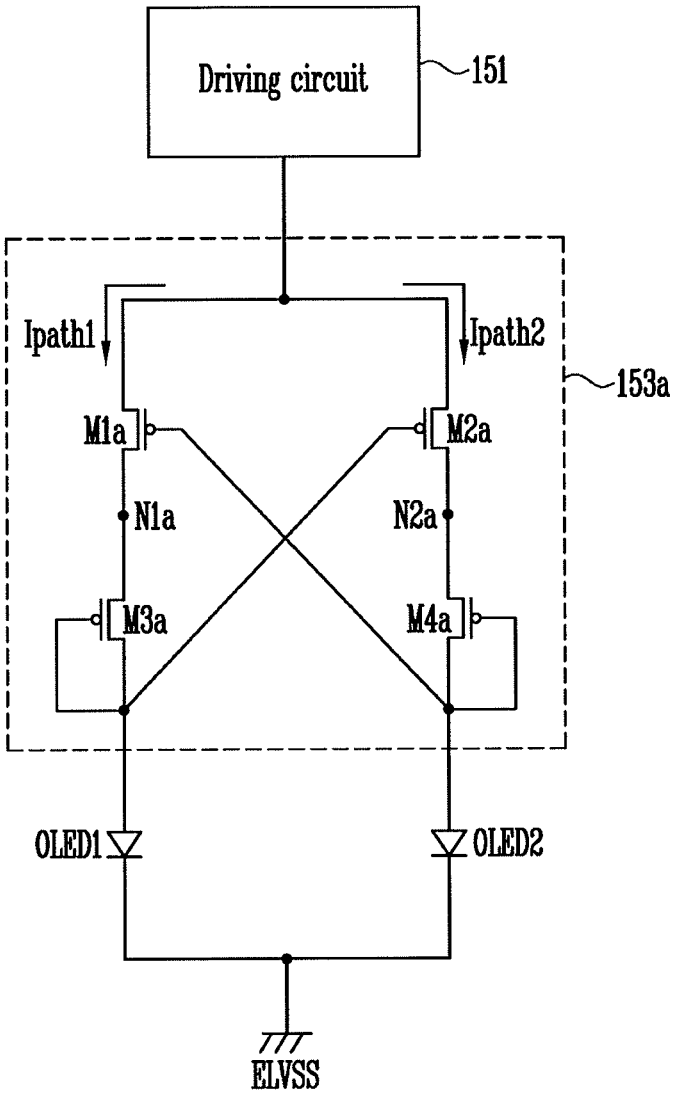
FIG. 3 illustrates an embodiment of a self-repair circuit.

FIG. 3 illustrates an embodiment of a self-repair circuit. This self-repair circuit 153*a* includes first to fourth transistors M1*a*, M2*a*, M3*a* and M4*a*. Each of the first to fourth transistors M1*a*, M2*a*, M3*a* and M4*a* is a P-channel field effect transistor. The first and third transistors M1*a* and M3*a* are coupled in series on first current path Ipath1. The second and fourth transistors M2*a* and M4*a* are coupled in series on second current path Ipath2. The first and second transistors M1*a* and M2*a* may operate in their saturation regions.

The first and second transistors M1*a* and M2*a* are cross-coupled. For example, a first electrode of first transistor M1*a* is coupled to the driving circuit 151. A second electrode of first transistor M1*a* is coupled to a first node N1*a*. A gate electrode of first transistor M1*a* is coupled to an anode electrode of OLED2. A first electrode of second transistor M2*a* is coupled to the driving circuit 151. A second electrode of second transistor M2*a* is coupled to a second node N2*a*. A gate electrode of second transistor M2*a* is coupled to an anode electrode of OLED1.

Each of third and fourth transistors M3*a* and M4*a* may be diode-coupled. For example, a first electrode of third transistor M3*a* may be coupled to first node N1*a*. A second electrode and a gate electrode of third transistor M3*a* are coupled to the anode electrode of OLED1. A first electrode of fourth transistor M4*a* is coupled to second node N2*a*. A second electrode and a gate electrode of fourth transistor M4*a* are coupled to the anode electrode of OLED2.

When OLED1 and OLED2 operate normally, first to fourth transistors M1*a* to M4*a* operate as negative feedback circuits to one another, to equally maintain the amplitude of the first current and amplitude of the second current.

For example, because third transistor M3*a* is diode-coupled, the voltage of the anode electrode of OLED1 decreases as the first current supplied through first current path Ipath1 increases. When the voltage of the anode electrode of OLED1 decreases, the voltage of the gate electrode of second transistor M2*a* decreases. Thus, the amplitude of the current flowing through second transistor M2*a* (e.g., amplitude of the second current supplied through second current path Ipath2) increases and the amplitude of the first current decreases.

When OLED1 and OLED2 operate normally, third and fourth transistors M3*a* and M4*a* operate to equally maintain the amplitude of the first current and the amplitude of the second current.

When either of OLED1 or OLED2 is short-circuited, first to fourth transistors M1*a* to M4*a* operate as positive feedback circuits, to interrupt (e.g., cut off) the current flowing through the short-circuited organic light emitting diode and to allow the entire current to flow through the organic light emitting diode which is not short-circuited.

For example, if OLED1 is short-circuited, the voltage of the anode electrode of OLED1 decreases to the voltage of the second power source ELVSS. If the voltage of the anode electrode of OLED1 decreases, the voltage of the gate electrode of second transistor M2*a* decreases. Thus, the amplitude of the current flowing through second transistor M2*a* (e.g., the amplitude of the second current supplied through the second current path Ipath2) increases. If the amplitude of the second current increases, the voltage of the anode electrode of OLED2 increases. If the voltage of the anode electrode of OLED2 increases, the voltage of the gate electrode of first transistor M1*a* increases. Thus, the amplitude of the current flowing through first transistor M1*a* (e.g., the amplitude of the first current supplied through the first current path Ipath1) decreases.

Figure 4:
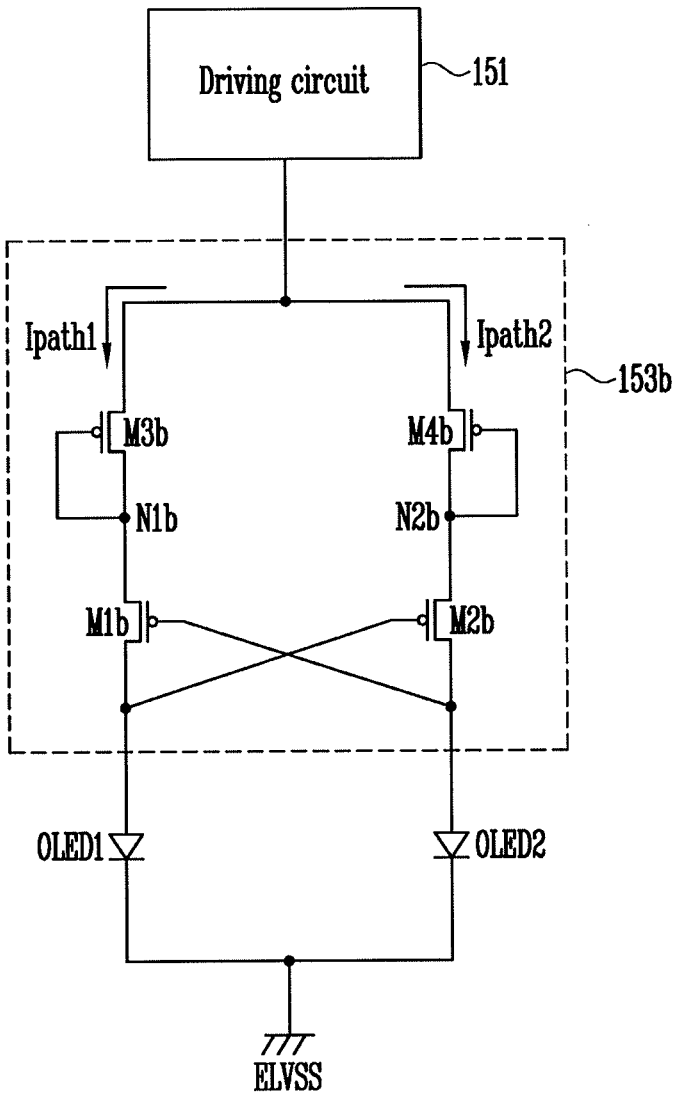
FIG. 4 illustrates another embodiment of a self-repair circuit.

FIG. 4 illustrates another embodiment of a self-repair circuit 153. The self-repair circuit 153*b* in FIG. 4 is substantially identical to the self-repair circuit 153*a* in FIG. 3, except the coupling order of first and third transistors M1*b* and M3*b* and the coupling order of second and fourth transistors M2*b* and M4*b*.

Referring to FIG. 4, the self-repair circuit 153*b* includes first to fourth transistors M1*b*, M2*b*, M3*b* and M4*b*. Each of the first to fourth transistors M1*b*, M2*b*, M3*b* and M4*b* is a P-channel field effect transistor. The first and second transistors M1*b* and M2*b* may operate in their saturation regions.

The first and second transistors M1*b* and M2*b* are cross-coupled. For example, a first electrode of first transistor M1*b* is coupled to a first node N1*b*. A second electrode of first transistor M1*b* is coupled to the anode electrode of OLED1. A gate electrode of first transistor M1*b* is coupled to the anode electrode of OLED2. A first electrode of second transistor M2*b* is coupled to a second node N2*b*. A second electrode of second transistor M2*b* is coupled to the anode electrode of OLED2. A gate electrode of second transistor M2*b* is coupled to the anode electrode of OLED1.

Each of the third and fourth transistors M3*b* and M4*b* may be diode-coupled. For example, a first electrode of third transistor M3*b* is coupled to driving circuit 151. A second electrode and a gate electrode of third transistor M3*b* are coupled to first node N1*b*. A first electrode of the fourth transistor M4*b* is coupled to driving circuit 151. A second electrode and a gate electrode of fourth transistor M4*b* are coupled to second node N2*b*.

When OLED1 and OLED2 operate normally, first to fourth transistors M1*b* to M4*b* operate as negative feedback circuits, to equally maintain the amplitude of the first current and the amplitude of the second current. For example, because third transistor M3*b* is diode-coupled, the voltage of first node N1*b* decreases as the first current supplied through first current path Ipath1 increases. Because the voltage of the first electrode of first transistor M1*b* decreases, the voltage of the anode electrode of OLED1 decreases. If the voltage of the anode electrode of OLED1 decreases, the voltage of the gate electrode of second transistor Mb2 decreases. Thus, the amplitude of the current flowing through second transistor M2*b* (e.g., the amplitude of the second current supplied through second current path Ipath2) increases and the amplitude of the first current decreases.

When organic light emitting diodes OLED1 and OLED2 operate normally, the third and fourth transistors M3*b* and M4*b* are operated to equally maintain the amplitude of the first current and the amplitude of the second current.

When either of OLED1 or OLED2 is short-circuited, the first to fourth transistors M1*b* to M4*b* operate as positive feedback circuits, to interrupt (e.g., cut off) the current flowing through the short-circuited organic light emitting diode and to allow the entire current to flow through the organic light emitting diode which is not short-circuited.

For example, if OLED1 is short-circuited, the voltage of the anode electrode of OLED1 decreases to the voltage of the second power source ELVSS. If the voltage of the anode electrode of OLED1 decreases, the voltage of the gate electrode of second transistor M2*b* decreases. Thus, the amplitude of the current flowing through second transistor M2*b* (e.g., the amplitude of the second current supplied through second current path Ipath2) increases. If the amplitude of the second current increases, the voltage of the anode electrode of OLED2 increases. If the voltage of the anode electrode of OLED2 increases, the voltage of the gate electrode of first transistor M1*b* increases. Thus, the amplitude of the current flowing through first transistor M1*b* (e.g., the amplitude of the first current supplied through first current path Ipath1) decreases.

Figure 5:
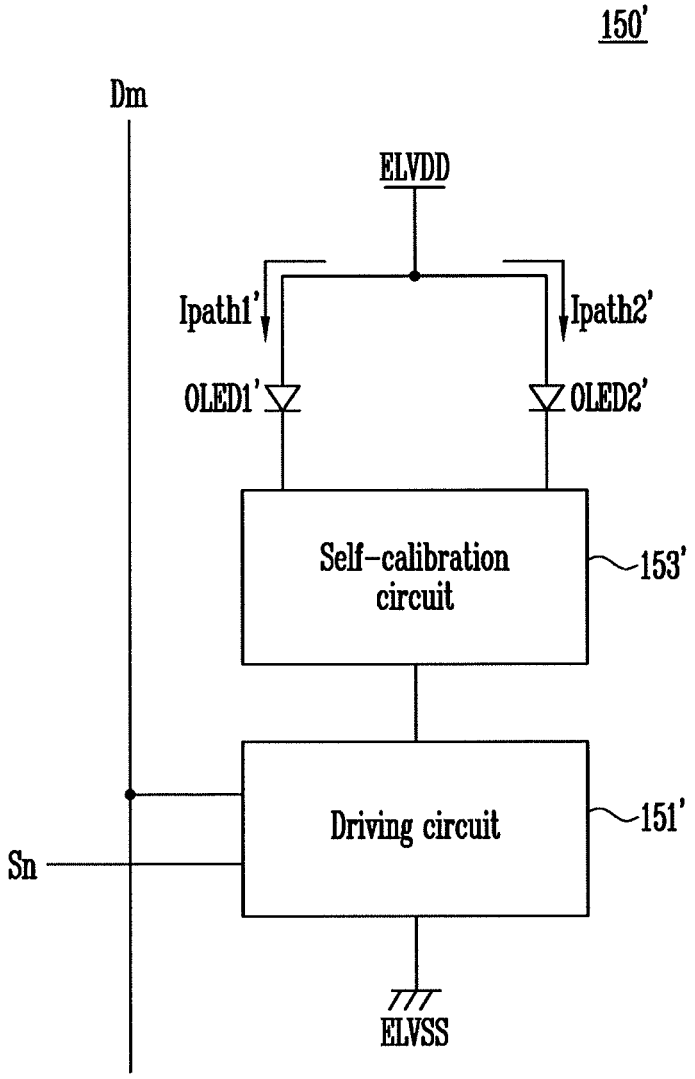
FIG. 5 illustrates another embodiment of a pixel.

FIG. 5 illustrates another embodiment of a pixel 150', which, for example, may correspond to pixel 150 in FIG. 1. The pixel 150' in FIG. 5 and pixel 150 in FIG. 2 may have a dual relationship, e.g., the pixel 150' in FIG. 5 may be a dual circuit of the pixel 150 in FIG. 2.

Referring to FIG. 5, pixel 150' includes a driving circuit 151', a self-repair circuit 153', and organic light emitting diodes OLED1' and OLED2'. The driving circuit 151' controls the amount of current flowing from first power source ELVDD to second power source ELVSS through OLED1' and OLED2', based on the data signal supplied through data line Dm when the scan signal is supplied through scan line Sn.

The self-repair circuit 153' maintains the amplitude of the first current supplied to OLED1' through a first current path Ipath1' to be substantially equal to that of the second current supplied to OLED2' through a second current path Ipath2'.

If any one of OLED1' or OLED2' is short-circuited, the self-repair circuit 153' interrupts the current supplied to the short-circuited organic light emitting diode and supplies the current to the other organic light emitting diode.

For example, if OLED1' is short-circuited, the self-repair circuit 153' interrupts the first current supplied to OLED1' through first current path Ipath1', and supplies only the second current supplied to OLED2' through second current path Ipath2'. In this case, the self-repair circuit 153' increases the amount of the second current supplied through second current path Ipath2' by an amount which corresponds to the reduction in the first current supplied through first current path Ipath1'.

OLED1' and OLED2' are coupled between the first power source ELVDD and the self-repair circuit 153'. OLED1' is coupled on the first current path Ipath1' and emits light with a luminance based on the first current supplied through first current path Ipath1'. OLED2' is coupled on second current path Ipath2 and emits light with a luminance based on the second current supplied through second current path Ipath2'.

Figure 6:
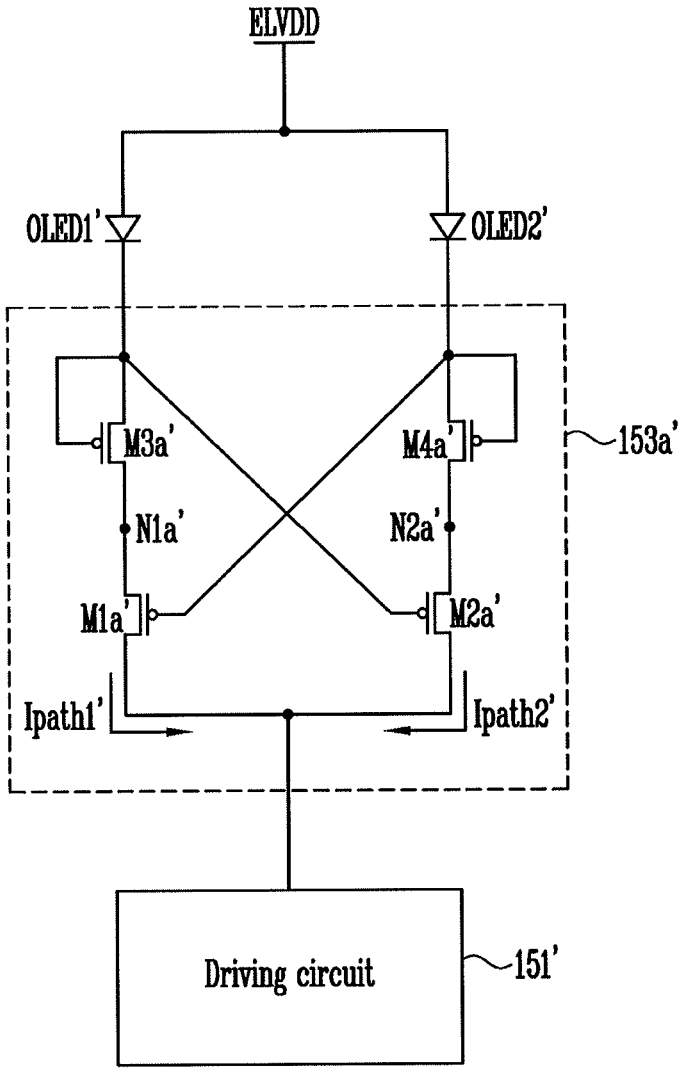
FIG. 6 illustrates an embodiment of a self-repair circuit in FIG. 5.

FIG. 6 illustrates an embodiment of the self-repair circuit 153' shown in FIG. 5. The self-repair circuit 153*a*' in FIG. 6 and the self-repair circuit 153*a* in FIG. 3 may have a dual relationship.

Referring to FIG. 6, the self-repair circuit 153*a*' includes first to fourth transistors M1*a*', M2*a*', M3*a*' and M4*a*'. Each of the first to fourth transistors M1*a*', M2*a*', M3*a*' and M4*a*' is an N-channel field effect transistor. The first and third transistors M1*a*' and M3*a*' are coupled in series on the first current path Ipath1'. The second and fourth transistors M2*a*' and M4*a*' are coupled in series on second current path Ipath2'. The first and second transistors M1*a*' and M2*a*' operate in their saturation regions.

The first and second transistors M1*a*' and M2*a*' are cross-coupled. For example, a first electrode of first transistor M1*a*' is coupled to the driving circuit 151'. A second electrode of first transistor M1*a*' is coupled to a first node N1*a*'. A gate electrode of first transistor M1*a*' is coupled to an anode electrode of OLED2'. A first electrode of second transistor M2*a*' is coupled to the driving circuit 151'. A second electrode of second transistor M2*a*' is coupled to a second node N2*a*'. A gate electrode of second transistor M2*a*' is coupled to an anode electrode of OLED2'.

Each of the third and fourth transistors M3*a*' and M4*a*' may be diode-coupled. For example, a first electrode of third transistor M3*a*' is coupled to the first node N1*a*'. A second electrode and a gate electrode of third transistor M3*a*' are coupled to the anode electrode of OLED1'. A first electrode of fourth transistor M4*a*' is coupled to second node N2*a*'. A second electrode and a gate electrode of fourth transistor M4*a*' are coupled to the anode electrode of OLED2'.

When OLED1' and OLED2' operate normally, the first to fourth transistors M1*a*' to M4*a*' operate as negative feedback circuits, to equally maintain the amplitude of the first current and the amplitude of the second current.

For example, because third transistor M3*a*' is diode-coupled, the voltage of the anode electrode of OLED1' increases as the amplitude of the first current supplied through first current path Ipath1' increases. If the voltage of the anode electrode of OLED1' increases, the voltage of the gate electrode of second transistor M2*a*' increases. Thus, the amplitude of current flowing through second transistor M2*a*' (e.g., the amplitude of the second current supplied through second current path Ipath2') increases and the amplitude of the first current decreases.

When OLED1' and OLED2' operate normally, the third and fourth transistors M3*a*' and M4*a*' operate to equally maintain the amplitude of the first current and the amplitude of the second current.

When either of OLED1' or OLED2' is short-circuited, the first to fourth transistors M1*a*' to M4*a*' operate as positive feedback circuits to interrupt (e.g., cut off) the current flowing through the short-circuited organic light emitting diode and to allow the entire current to flow through the organic light emitting diode which is not short-circuited.

For example, if OLED1' is short-circuited, the voltage of the anode electrode of OLED1' increases to the voltage of the first power source ELVDD. If the voltage of the anode electrode of OLED1' increases, the voltage of the gate electrode of second transistor M2*a*' increases. Thus, the amplitude of the current flowing through second transistor M2*a*' (e.g., the amplitude of the second current supplied through second current path Ipath2') increases. If the amplitude of the second current increases, the voltage of the anode electrode of OLED2' decreases. If the voltage of the anode electrode of OLED2' decreases, the voltage of the gate electrode of first transistor M1*a*' decreases. Thus, the amplitude of the current flowing through first transistor M1*a*' (e.g., the amplitude of the first current supplied through first current path Ipath1') decreases.

Figure 7:
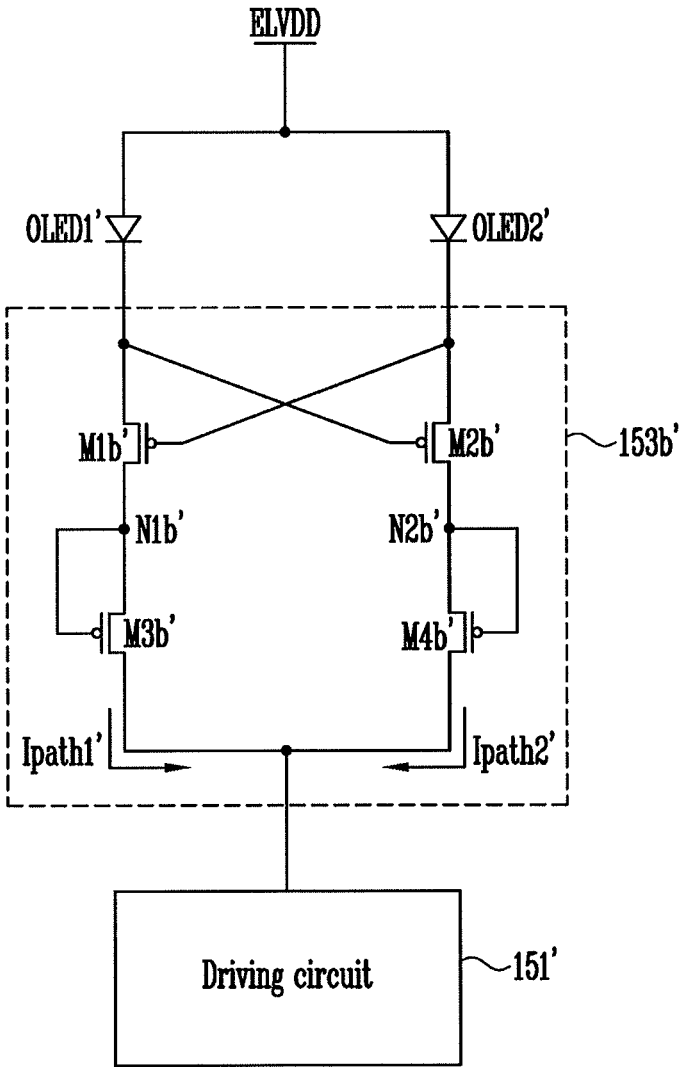
FIG. 7 illustrates another embodiment of a self-repair circuit in FIG. 5.

FIG. 7 illustrates another embodiment of the self-repair circuit shown in FIG. 5. The self-repair circuit 153*b*' in FIG. 7 and the self-repair circuit 153*b* in FIG. 4 may have a dual relationship. The self-repair circuit 153*b*' in FIG. 7 may be substantially identical to the self-repair circuit 153*a*' in FIG. 6, except the coupling order of first and third transistors M1*b*' and M3*b*' and the coupling order of second and fourth transistors M2*b*' and M4*b*'.

Referring to FIG. 7, the self-repair circuit 153*b*' includes first to fourth transistors M1*b*', M2*b*', M3*b*' and M4*b*'. Each of the first to fourth transistors M1*b*', M2*b*', M3*b*' and M4*b*' is an N-channel field effect transistor. The first and second transistors M1*b*' and M2*b*' operated in their saturation regions.

The first and second transistors M1*b*' and M2*b*' are cross-coupled. For example, a first electrode of first transistor M1*b*' is coupled to a first node N1*b*'. A second electrode of first transistor M1*b*' is coupled to the anode electrode of OLED1'. A gate electrode of first transistor M1*b*' is coupled to the anode electrode of OLED2'. A first electrode of second transistor M2*b*' is coupled to a second node N2*b*'. A second electrode of second transistor M2*b*' is coupled to the anode electrode of OLED2'. A gate electrode of second transistor M2*b*' is coupled to the anode electrode of OLED1'.

Each of the third and fourth transistors M3*b*' and M4*b*' may be diode-coupled. For example, a first electrode of third transistor M3*b*' is coupled to driving circuit 151'. A second electrode and a gate electrode of third transistor M3*b*' are coupled to first node N1*b*'. A first electrode of fourth transistor M4*b*' is coupled to the driving circuit 151'. A second electrode and a gate electrode of fourth transistor M4*b*' are coupled to second node N2*b*'.

When OLED1' and OLED2' operate normally, first to fourth transistors M1*b*' to M4*b*' operate as negative feedback circuits, to equally maintain the amplitude of the first current and the amplitude of the second current.

For example, because third transistor M3*b*' is diode-coupled, the voltage of the first electrode of first transistor M1*b*' increases as the amplitude of the first current supplied through first current path Ipath1' increases. Because the voltage of the first electrode of first transistor M1*b*' increases, the voltage of the anode electrode of OLED1' increases. If the voltage of the anode electrode of OLED1' increases, the voltage of the gate electrode of second transistor M2*b*' increases. Thus, the amplitude of the current flowing through second transistor M2*b*' (e.g., the amplitude of the second current supplied through second current path Ipath2') increases and the amplitude of the first current decreases.

When OLED1' and OLED2' operate normally, the third and fourth transistors M3*b*' and M4*b*' operate to equally maintain the amplitude of the first current and the amplitude of the second current.

When either of OLED1' or OLED2' is short-circuited, the first to fourth transistors M1*b*' to M4*b*' operate as positive feedback circuits, to interrupt the current flowing through the short-circuit organic light emitting diode and to allow the entire current to flow through the organic light emitting diode which is not short-circuited.

For example, if the first organic light emitting diode OLED1' is short-circuited, the voltage of the anode electrode of OLED1' increases to the voltage of first power source ELVDD. If the voltage of the anode electrode of OLED1' increases, the voltage of the gate electrode of second transistor M2*b*' increases. Thus, the amplitude of the current flowing through second transistor M2*b*' (e.g., the amplitude of the second current supplied through second current path Ipath2') increases. If the amplitude of the second current increases, the voltage of the anode electrode of OLED2' decreases. If the voltage of the anode electrode of OLED2' decreases, the voltage of the gate electrode of the first transistor M1*b*' decreases. Thus, the amplitude of the current flowing through first transistor M1*b*' (e.g., the amplitude of the first current supplied through first current path Ipath1') decreases.

By way of summation and review, in a general case, if an organic light emitting diode is short-circuited by a defect (which, for example, occurs during manufacturing or use thereof), the organic light emitting diode will not emit light or may emit light with an unintended gray scale value, even though the organic light emitting diode receives current.

In accordance with one or more of the aforementioned embodiment, a pixel includes two organic light emitting diodes coupled to a self-repair circuit. When one of the organic light emitting diodes experiences a short circuit or other type of defect, the self-repair circuit diverts current that normally would flow to the defective organic light emitting diode to the organic light emitting which is not defective, in order to express an accurate gray scale value corresponding to a data signal. Further, in accordance with one or more embodiments, it is possible to reduce degradation of the organic light emitting diode.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel corresponding to an intersection portion of a data line and a scan line, comprising:

a driving circuit to supply a current based on a data signal supplied through the data line;

a first organic light emitting diode (OLED) to receive the current through a first current path;

a second OLED to receive the current through a second current path; and a self-repair circuit, wherein:

the self-repair circuit interrupts the first current path and supplies the current to the second current path by operating in a positive feedback circuit when the first OLED is defective, and the self-repair circuit supplies the current to the first and second current paths by operating in a negative feedback circuit such that the first and second OLEDs simultaneously emit light when the first and second OLEDs are normal, and wherein the first and second OLEDs are connected to the driving circuit.

2. The pixel as claimed in claim 1, wherein the self-repair circuit equally supplies the current to the first current path and the second current path when the first OLED is not defective.

3. The pixel as claimed in claim 2, wherein:

the self-repair circuit increases an amount of a second current flowing through the second current path when the first OLED is defective, and the increased amount of the second current is based on a reduction in an amount of a first current flowing through the first current path.

4. The pixel as claimed in claim 1, wherein the self-repair circuit includes:

a first transistor having a first electrode coupled to the driving circuit, a second electrode coupled to a first node, and a gate electrode coupled to an anode electrode of the second OLED:

a second transistor having a first electrode coupled to the driving circuit, a second electrode coupled to a second node, and a gate electrode coupled to an anode electrode of the first OLED;

a third transistor having a first electrode coupled to the first node, and a second electrode and a gate electrode, coupled to the anode electrode of the first OLED; and a fourth transistor having a first electrode coupled to the second node, and a second electrode and a gate electrode coupled to the anode electrode of the second OLED.

5. The pixel as claimed in claim 4, wherein the first and second transistors are to operate in a saturation region.

6. The pixel as claimed in claim 4, wherein the first to fourth transistors are same-channel field effect transistors.

7. The pixel as claimed in claim 1, wherein the self-repair circuit includes:

a first transistor to have a first electrode coupled to a first node, a second electrode coupled to an anode electrode of the first OLED, and a gate electrode coupled to an anode electrode of the second OLED;

a second transistor to have a first electrode coupled to a second node, a second electrode coupled to the anode electrode of the second OLED, and a gate electrode coupled to the anode electrode of the first OLED;

a third transistor to have a first electrode coupled to the driving circuit, and a second electrode and a gate electrode coupled to the first node; and a fourth transistor to have a first electrode coupled to the driving circuit, and a second electrode and a gate electrode coupled to the second node.

8. An organic light emitting display, comprising:

a data driver to supply data signals to data lines;

a scan driver to progressively supply a scan signal to scan lines; and a display unit including pixels respectively arranged at intersection portions of the data lines and scan lines, wherein each pixel corresponding to an intersection portion of a corresponding one of the data lines and a corresponding one of the scan lines, each pixel includes:

a first organic light emitting diode (OLED);

a second OLED;

a driving circuit to control an amount of current flowing from a first power source to a second power source through the first and second OLEDs based on a data signal supplied through the corresponding one of the data lines, when the scan signal is supplied to the corresponding one of the scan lines; and a self-repair circuit, wherein:

the self-repair circuit interrupts a first current supplied to the first OLED by operating in a positive feedback circuit when the first OLED is defective, and the self-repair circuit supplies current supplied from the driving circuit to the first and second OLEDs by operating in a negative feedback circuit such that the first and second OLEDs simultaneously emit light when the first and second OLEDs are normal, and wherein the first and second OLEDs are connected to the driving circuit.

9. The display as claimed in claim 8, wherein the self-repair circuit is to equally supply the current supplied from the driving circuit to the first and second OLEDs when the first OLED is not defective.

10. The display as claimed in claim 9, wherein:

the self-repair circuit increases an amount of a second current supplied to the second OLED when the first OLED is defective, and the increased amount of the second current is based on a reduction in the first current.

11. The display as claimed in claim 8, wherein the self-repair circuit includes:

a first transistor having a first electrode coupled to the driving circuit, a second electrode coupled to a first node, and a gate electrode coupled to an anode electrode of the second OLED, a second transistor having a first electrode coupled to the driving circuit, a second electrode coupled to a second node, and a gate electrode coupled to an anode electrode of the first OLED, a third transistor having a first electrode coupled to the first node, and a second electrode and a gate electrode, coupled to the anode electrode of the first OLED; and a fourth transistor having a first electrode coupled to the second node, and a second electrode and a gate electrode, coupled to the anode electrode of the second OLED.

12. The display as claimed in claim 11, wherein the first and second transistors are to operate in a saturation region.

13. The display as claimed in claim 11, wherein the first to fourth transistors are same-channel field effect transistors.

14. The display as claimed in claim 8, wherein the self-repair circuit includes:

a first transistor having a first electrode coupled to a first node, a second electrode coupled to an anode electrode of the first OLED, and a gate electrode coupled to an anode electrode of the second OLED;

a second transistor having a first electrode coupled to a second node, a second electrode coupled to the anode electrode of the second OLED, and a gate electrode coupled to the anode electrode of the first OLED;

a third transistor having a first electrode coupled to the driving circuit, and a second electrode and a gate electrode, coupled to the first node; and a fourth transistor having a first electrode coupled to the driving circuit, and a second electrode and a gate electrode, coupled to the second node.

15. The display as claimed in claim 8, wherein the driving circuit includes:

a storage capacitor;

a scanning transistor to charge, in the storage capacitor, a voltage corresponding to the data signal supplied through the corresponding one of the data lines, when the scan signal is supplied to the corresponding one of the scan lines; and a driving transistor to control the amount of the current based on the voltage charged in the storage capacitor.

16. A pixel corresponding to an intersection portion of a data line and a scan line, comprising:

a first light emitter;

a second light emitter;

a driver circuit to supply a first current; and a control circuit, wherein:

the control circuit supplies a second current to the first light emitter and a third current to the second light emitter by operating in a negative feedback circuit such that the first and second light emitters simultaneously emit light when the first and second light emitters are normal, and the control circuit supplies at least a portion of the second current to the second light emitter with the third current by operating in a positive feedback circuit when the first light emitter is defective, wherein the first and second light emitters are connected in parallel, wherein the second and third currents are based on the first current, and wherein the first and second light emitters are connected to the driver circuit.

17. The pixel as claimed in claim 16, wherein the control circuit is to supply the second current to the second light emitter with the third current when the first light emitter is defective.

18. The pixel as claimed in claim 16, wherein the first and second light emitters are organic light emitting diodes.

19. The pixel as claimed in claim 16, wherein the third current substantially equals the second current.

20. The pixel as claimed in claim 16, wherein control circuit is to interrupt a signal path coupled to the first light emitter to supply at least a portion of the second current to the second light emitter with the third current.

* * * * *